United States Patent [19]

Little, Jr. et al.

[11] 3,952,700

[45] Apr. 27, 1976

[54] LIQUID APPLICATOR

[75] Inventors: William S. Little, Jr., Rochester; Robert H. Townsend, Webster, both of N.Y.

[73] Assignee: Xerox Corporation, Stamford, Conn.

[22] Filed: Aug. 30, 1972

[21] Appl. No.: 284,803

Related U.S. Application Data

[62] Division of Ser. No. 87,720, Nov. 9, 1970, Pat. No. 3,703,459.

[52] U.S. Cl. ..... 118/637; 118/259; 118/262

[51] Int. Cl.[2] ..... G03G 15/10

[58] Field of Search ..... 118/259, 410, 413, 414, 118/262, 258, 637; 101/350, 363; 355/10, 3

[56] References Cited

UNITED STATES PATENTS

| | | | |
|---|---|---|---|
| 2,328,183 | 8/1943 | Barrett | 118/413 |
| 2,796,846 | 6/1957 | Trist | 118/410 |
| 3,030,917 | 4/1962 | Brown et al. | 118/413 |
| 3,285,225 | 11/1966 | Recor | 118/410 |
| 3,418,970 | 12/1968 | Phelps et al. | 118/410 |

FOREIGN PATENTS OR APPLICATIONS

| | | | |
|---|---|---|---|
| 1,075,934 | 2/1960 | Germany | 118/414 |
| 1,039,469 | 9/1958 | Germany | 118/414 |
| 1,964,908 | 8/1970 | Germany | 118/414 |

*Primary Examiner*—John P. McIntosh
*Attorney, Agent, or Firm*—James J. Ralabate; David C. Petre; Charles E. Smith

[57] ABSTRACT

A liquid applicator is provided adapted to apply a uniform liquid film to a surface regardless of the spatial orientation of the liquid applicator.

6 Claims, 3 Drawing Figures

LIQUID APPLICATOR

This application is a division of application Ser. No. 87,720, filed Nov. 9, 1970, now U.S. Pat. No. 3,703,459.

This invention relates to a liquid applicator. More specifically, this invention relates to a liquid applicator for use in an electrophoretic imaging system.

In photoelectrophoretic imaging, colored photosensitive particles are suspended in an insulating carrier liquid. This suspension is then placed between at least two electrodes subjected to a potential difference and exposed to a light image. Ordinarily, in carrying out the process, the imaging suspension is placed on a transparent electrically conductive support in the form of a thin liquid film and exposure is made through the transparent support while a second generally cylindrically shaped biased electrode is rolled across this suspension. The particles are believed to bear an initial charge once suspended in the liquid carrier which causes them to be attracted to the transparent base electrode and upon exposure, to change polarity by exchanging charge with the base electrode so that the exposed particles migrate to the second or roller electrode thereby forming images on each of the electrodes, by particle subtraction, each image being complementary one to the other. The process can be employed to produce both polychromatic and monochromatic images. In the latter instance, a single color photoresponsive particle may be used in the suspension or a number of differently colored photoresponsive particles may be used all of which will respond to the light to which the suspension is exposed. An extensive and detailed description of the photoelectrophoretic imaging techniques as generally referred to can be found in U.S. Pat. Nos. 3,383,993, 3,384,488, 3,384,565 and 3,384,566, which are hereby incorporated by reference.

Generally, a uniform layer of the imaging suspension has heretofore been applied to the surface of the transparent electrode by a donor drum or applicator such as a urethane coated cylinder which can rotate in the same or opposite direction as the transparent electrode. The function of the donor drum is to apply a thin film of the imaging suspension from an ink supply source such as an ink sump by way of a roller to the transparent electrode. The use of an ink sump from which the ink is indirectly supplied to the transparent electrode has imposed restrictions upon the positioning of the ink supply within the electrophoretic system and has also required the use of several transfer rolls and the additional equipment necessary to support such moving parts.

Accordingly, it is an object of the present invention to provide a simple, compact liquid applicator.

It is another object of the present invention to provide a liquid applicator adapted to supply a liquid film to a surface regardless of the spatial orientation of the applicator.

It is still another object of the present invention to provide a liquid applicator which can be employed for both supplying the imaging suspension to the transparent electrode and alternatively be employed for convenient cleaning of said electrode upon termination of an imaging cycle.

It is still a further object of the present invention to provide a liquid applicator with few, if any, moving parts.

These as well as other objects are accomplished by the present invention which provides an apparatus adapted to supply a liquid film to a surface regardless of the spatial orientation of the apparatus comprising:

i. a backing plate having leading and trailing endwalls and orthogonally disposed sidewalls, said plate being coterminous with the width of the surface to which a liquid film is to be applied;

ii. a pair of spaced endwall sealing members integral with said backing plate and extending coterminously with the width of the surface to which a liquid film is to be applied, one of said members being situated proximate the leading endwall of said plate, the other member being situated proximate the trailing endwall thereof;

iii. a pair of spaced sidewall sealing members integral with the sidewalls of said plate and extending to said endwall sealing members adapted to effect a seal with the surface to which a liquid film is to be applied; said plate, endwall sealing members and sidewall sealing members cooperating with the surface to which a liquid film is to be applied to form a sealed chamber therebetween;

iv. means for charging and withdrawing a liquid to and from said chamber; and v. means for regulating the contact pressure of said endwall sealing members with the surface to which a liquid film is to be applied, whereupon relative motion between said endwall sealing members and said surface, a liquid film is uniformly applied to said surface.

The present invention will become more apparent upon consideration of the following detailed disclosure of the invention, especially when taken in conjunction with the accompanying drawings wherein.

Figure 1:
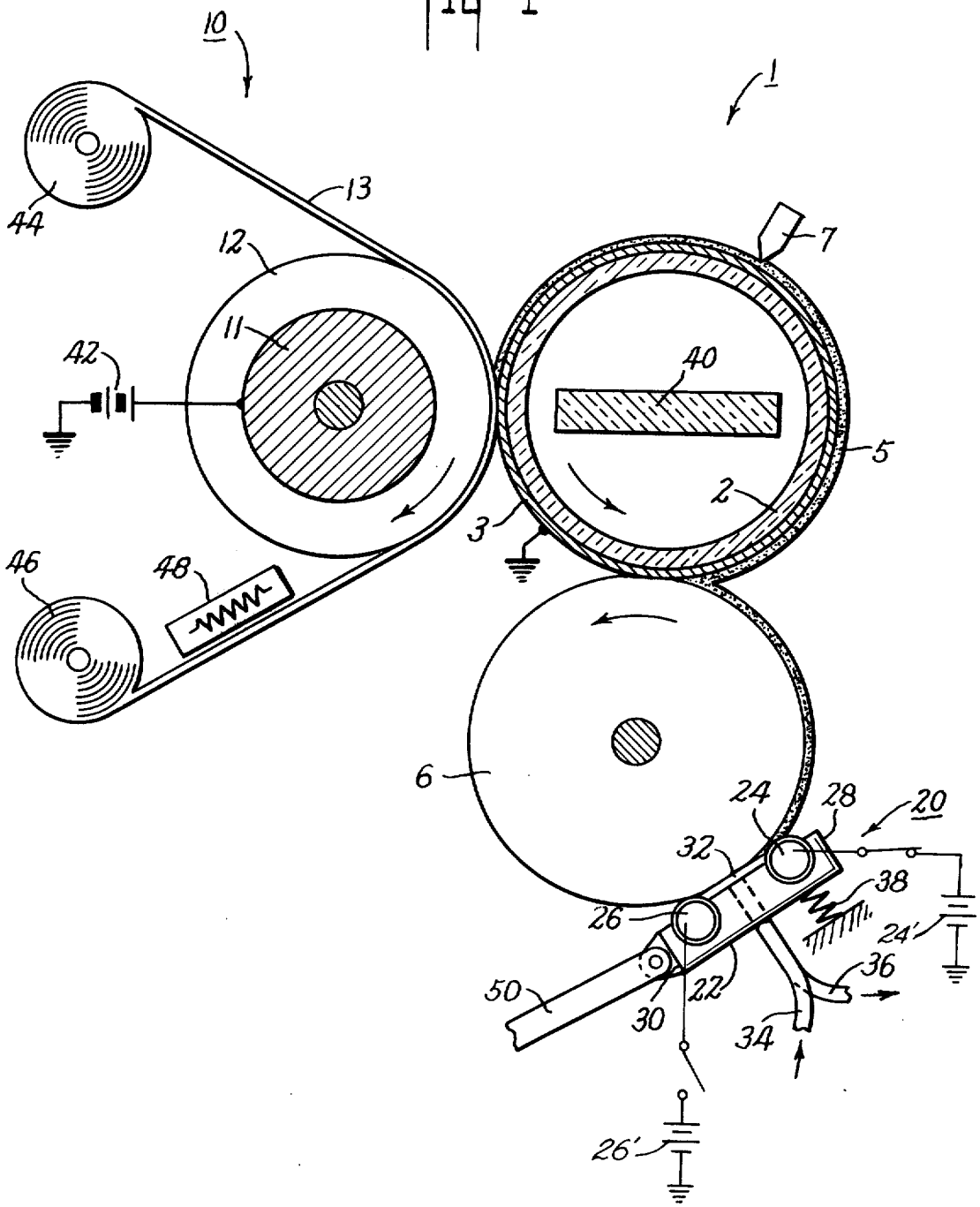
FIG. 1 is a schematic diagram of a continuous photoelectrophoretic imaging system illustrating one mode of employing the liquid applicator of the present invention.

Referring now to FIG. 1, there is seen a continuous photoelectrophoretic imaging system comprising transparent electrode 1 and imaging electrode 10. The transparent electrode 1 is represented as consisting of a layer of optically transparent glass 2 overcoated with a very thin optically transparent layer of tin oxide 3. Tin oxide coated glass of this nature is commercially available as NESA glass. A layer of an imaging suspension 5 is coated on the surface of the transparent electrode 1 by a donor drum 6 of any suitable design or material, such as a urethane coated cylinder, which may rotate in the same direction or, as herein represented, in the opposing direction to that of the transparent cylinder.

The liquid applicator of the present invention represented generally as 20 applies a thin film of the imaging suspension 5 to the donor drum 6 which in turn transfers the imaging suspension to the transparent electrode 1. The liquid applicator 20 comprises a generally rectangular backing plate 22 having leading and trailing endwalls 28 and 30, respectively, the orthogonally disposed sidewalls 29 and 31 (see FIG. 3), the endwalls thereof being coterminous with the width of the donor drum 6. Endwall sealing members 24 and 26 are integrally associated with said backing plate 22 and are situated proximate the leading and trailing endwalls 28 and 30 respectively of said backing plate 22. Sidewall sealing members 32 and 32' are integral with the sidewalls of said plate and extend to endwall sealing members 24 and 26 and conform with the surface of the donor drum 6 to effect a seal with said surface. The backing plate, endwall sealing members and sidewall sealing members cooperate with the donor drum surface to form a sealed chamber therebetween. A pump (not shown) is adapted to charge the imaging suspension through line 34 to said chamber and to withdraw said imaging suspension from said chamber through line 36. A spring 38 is provided as a means for regulating the contact pressure of the endwall sealing member 24 with the surface of the donor drum 6 whereupon relative motion between said liquid applicator 20 and the surface of said donor drum 6, a uniform liquid film of imaging suspension is applied to the surface of the donor drum. By regulating the pressure on endwall sealing member 24, the film thickness of the imaging suspension can be varied as desired. Additionally, the film thickness can be controlled by varying the internal pressure on the pumped imaging suspension. Sufficient pressure is maintained upon endwall sealing member 26 employing similar means as spring 38 or the like to effect a seal with the surface of the donor drum 6.

In close proximity to the transparent electrode 1 is a second rotary electrode 10 having a conductive central core 11 which is covered with a layer of material 12 such as polyurethane, the function of which is to block the rapid exchange of electric charges between the particles in the imaging suspension and the electrode 1. Although this layer of material need not necessarily be employed in this system, the use of such a layer is preferred because of the markedly improved results which it is capable of producing. A detailed description of the improved results and the types of materials which may be employed as the blocking layer may be found in U.S. Pat. No. 3,383,993.

A receiver sheet 13 is driven between the cylinders 1 and 10 as represented with an ink image being selectively deposited on the receiver sheet in the imaging zone. A residual image pattern opposite in image sense to the image developed on the receiver sheet is formed on the NESA glass cylinder which is removed upon subsequent contact with the donor drum 6. Thus, the donor drum 6 can perform both the ink application and residual ink removal steps.

The thickness of the film of imaging suspension on the NESA glass cylinder can be regulated prior to entering the imaging zone through use of a doctor blade 7 or similar device. As the imaging suspension enters the imaging zone between the transparent and blocking electrodes, an image is projected into the nip of the rollers by way of a first surface mirror 40 while a field is established across the imaging zone as the result of power source 42. Through the entire operation, the NESA glass roller electrode is connected to ground. The receiver sheet 13 herein represented in the form of a paper web is fed from a supply roll 44, passes between the glass transparent injecting electrode and the blocking electrode and is rewound on takeup roller 46. A heated metallic shoe 48 in contact with the underside of the paper web supplies the energy for fixing the image thereon.

Any suitable insulating carrier liquid can be employed as the carrier for the imaging suspension employed in the present invention. Typical vehicles include decane, dodecane, tetradecane, Sohio Solvent 3454 (a kerosene fraction available from Standard Oil Company of Ohio) dimethylsiloxane, olive oil, linseed oil, mineral oil, cottonseed oil, marine oils such as sperm oil and cod liver oil and mixtures thereof.

For polychromatic photoelectrophoretic imaging, the particles employed in the imaging suspension are selected so that those of different colors respond to different wave lengths in the visible spectrum corresponding to their principal absorption and further so that their spectral response curves do not have substantial overlap, thus allowing for color separation and subtractive multi-color image formation.

For full substractive color imaging, several different particles are employed, namely, a cyan colored particle sensitive mainly to red light, a magenta colored particle sensitive mainly to green light and a yellow colored particle sensitive mainly to blue light. While this is the simplest combination, additional particles having different absorption maxima may be added to improve color synthesis. When mixed together in the carrier liquid, these particles produce a black-appearing liquid and when one or more of the particles are caused to migrate from the transparent electrode toward the blocking electrode, they leave behind particles which produce a color equivalent to the color of the impinging light source. Thus, for example, red light exposure causes the cyan colored pigment to migrate thereby leaving behind the magenta and yellow pigments which combine to produce red in the final image. In the same manner, blue and green colored light are reproduced by removal of yellow and magenta respectively, and, of course, when white light impinges on the mix, all pigments migrate leaving behind the color of the white or transparent substrate. No exposure leaves behind all pigments which combine to produce the black image.

Depending upon the particular use to which the system is to be put, the imaging suspension may contain one, two, three, or even more different particles of various colors and having different ranges of spectral response. Thus, for example, in a monochromatic system, the particles included in the imaging suspension may be virtually any color in which it is desired to produce the final image such as gray, black, blue, red, yellow and the like and the particular point or range of its spectral response is relatively immaterial as long as it shows response to some region of the visible spectrum which can be matched by a convenient exposure source. There should, however, be substantial coincidence between the primary spectral absorption range and the primary photosensitive response range of the particles to insure high photographic sensitivity in the system. In fact, in a monochromatic system, the pigment may vary in response from one with a very narrow response band all the way up to one having panchromatic response. For a more detailed discussion of pigments suitable for monochromatic and polychromatic photoelectrophoretic imaging suspensions, reference is made to U.S. Pat. Nos. 3,384,488 and 3,384,566 which are incorporated herewith by reference.

A wide range of voltages may be applied between the electrodes in the system at which imaging occurs. It is preferred in order to obtain good image resolution that the potential be such as to create an electric field of at least about 60 volts per micron across the imaging layer. The applied potential necessary to obtain the desired field strength will of course vary depending upon the interelectrode gap and upon the thickness and type of blocking material used on the respective imaging electrode surfaces. Voltages as high as 8,000 volts have been applied to produce images of high quality. The upper limit of the field strength is limited only by the breakdown potential of the suspension and blocking electrode material.

Imaging as carried out in conjunction with the present invention is generally in a negative to positive or positive to negative imaging mode. Thus, for purposes of the present discussion in order to produce a positive image on the receiver sheet a negative image is projected onto the imaging suspension passing through the nip. As discussed above, a potential is applied across the imaging suspension and as a result of the exposure to the actinic radiation, the exposed pigment particles initially suspended in the carrier liquid migrate through the carrier to the surface of the blocking electrode or, in the instance of the above described illustration, to the surface of the intervening receiver paper sheet. The pigment image formed, whether it be on a removable blocking electrode layer attached to the conductive core of the imaging roller or to a receiver copy sheet may be fixed in place, for example by placing a lamination over its top surface such as by spraying with a thermoplastic composition or by the application of heat such as by the utilization of a heated metallic shoe which is in contact with the underside of the paper web as in the present illustration. When a fusible polymeric material such as a thermoplastic resin is utilized in conjunction with the pigment particles the system of the present invention presents a built-in image fixing mechanism when utilizing heat fixing or vapor fixing techniques. In addition, the application of heat further assists in the fixing process by accelerating the solvent removal from the image areas. If desired, the image may be transferred to a secondary substrate to which it is in turn fixed. The system herein described produces a high contrast monochromatic or polychromatic color image either in a positive to negative or negative to positive imaging mode.

If the image is formed on a permanent electrode surface and the intervening receiver sheet is eliminated, it will be found desirable to transfer the image from the electrode and fix it on a secondary substrate so that the electrode may be reused. Such a transfer step may be carried out by adhesive pick off techniques or preferably by electrostatic field transfer. If the imaging roller is covered with a transfer paper sleeve or, as illustrated, a web is passed between the contacting surfaces of the transparent and imaging rollers or if the blocking material utilized consists of a removable sleeve, such as Tedlar, this intervening substrate will pick up the complete image on the initial pass and need only be removed to produce the final usable copy. All that is required is to replace the substrate with a similar material. In the present configuration, images are produced directly on a paper receiving sheet or other substrate with the residual image formed on the NESA or transparent cylinder removed by the action of the donor drum. However, if desired the image formed on the NESA cylinder need not be discarded but may be utilized by offsetting the image from the NESA cylinder onto the surface of a conventional receiving sheet such as described above. Any suitable material may be used as a receiving substrate for the image produced such as paper as represented in the illustration or other desirable substrates. For example, if one desires to produce a transparency, the use of a Mylar or Tedlar sheet might be desirable.

When used in the course of the present invention, the term "injecting electrode" should be understood to mean that it is an electrode which will preferably be capable of exchanging charge with the photosensitive particles of the imaging suspension when the suspension is exposed to light so as to allow for a net change in the charge polarity on the particle. By the term "blocking electrode" is meant one which is capable of injecting the electrons into or receiving electrons from the above mentioned photosensitive particles at a negligible rate when the particles come into contact with the surface of the electrode.

It is preferred that the injecting electrode be composed of an optically transparent material, such as glass, overcoated with a transparent or semi-transparent conductive material such as tin oxide, indium oxide, copper iodide, aluminum or the like; however, other suitable materials including many semiconductive materials such as raw cellophane, which are ordinarily not thought of as being conductors but are which still capable of accepting injected charge carriers on the proper polarity under the influence of an applied electric field may be used. The use of more conductive materials allows for cleaner charge separation and prevents possible charge buildup on the electrode, the latter tending to diminish the electric field across the suspension in an undesirable manner. The blocking electrode, on the other hand, is selected so as to prevent or greatly retard the injection of electrons into the photosensitive pigment particles when the particles reach the surface of this electrode. The core of the blocking electrode generally will consist of a material which is fairly high in electrical conductivity. Typical conductive materials include conductive rubber, steel, aluminum, copper and brass. Preferably the core of the electrode will have a high electrical conductivity in order to establish the required polarity differential in the system; however, if a material having a low conductivity is used, a separate electrical connection may be made to the back of the blocking layer of the blocking electrode. For example, the blocking layer or sleeve may be a semiconductive polyurethane material having a conductivity of from about $10^{-8}$ to $10^{-9}$ ohm-cm. If a hard rubber non-conductive core is used, then a metal foil may be used as a backing for the blocking sleeve. Although a blocking electrode material need not necessarily be used in the system, the use of such a layer is preferred because of the markedly improved results which it is capable of producing. It is preferred that the blocking layer, when employed, be either an insulator or a semiconductor which will not allow for the passage of sufficient charge carriers, under the influence of the applied field, to discharge the particles finely bound to its surface thereby preventing particle oscillation in the system. The result is enhanced image density and resolution. Even if the blocking layer does allow for the passage of some charge carriers to the photosensitive particles it still will be considered to fall within the class of preferred materials if it does not allow for the passage of sufficient charge so as to recharge a sufficient number of the particles to the opposite polarity to degrade the quality of the print. Illustrative of blocking materials which can be employed are baryta paper, Tedlar polyvinylfluoride, Mylar polyethylene terephthalate, and polyurethane. Any other suitable material having a resistivity of from about $10^7$ ohms-cm or greater may be employed. Typical materials in this resistivity range include cellulose acetate coated papers, cellophane, polystyrene and polytetrafluoroethylene. Other materials that may be used in the injecting and blocking electrodes and other photosensitive particles which can be used as the photomigratory pigments and the various conditions under which the system operates may be found in the above cited patents U.S. Pat. Nos. 3,384,565 and 3,384,566 as well as U.S. Pat. Nos. 3,384,488 and 3,389,993.

Figure 2:
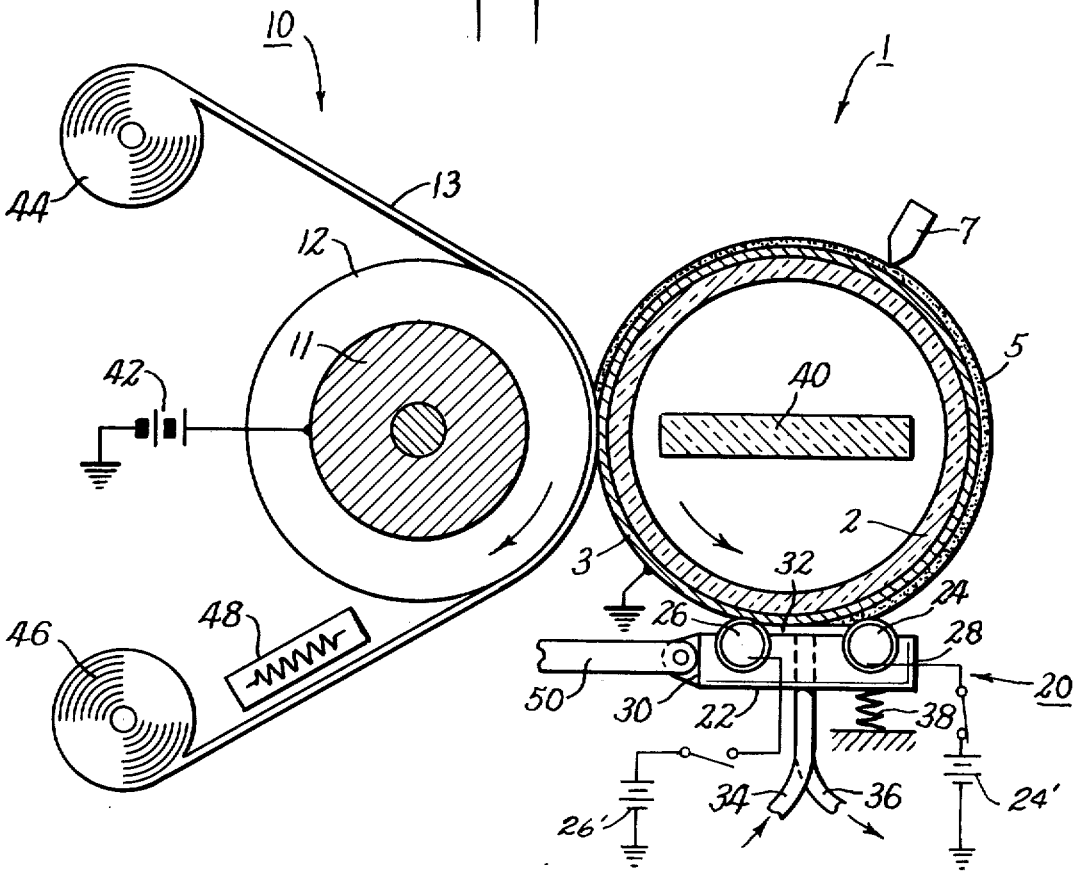
FIG. 2 is a schematic diagram of a photoelectrophoretic imaging system illustrating an alternate mode of employing the liquid applicator of the present invention.

The liquid applicator of the present invention provides a simple, compact applicator for the imaging suspension employed in monochromatic and polychromatic photoelectrophoretic imaging systems. The endwall sealing members 24 and 26 may be connected to the power sources 24' and 26' respectively, to electrically bias the endwall sealing members. As is apparent from the drawings, the liquid applicator can be employed to supply ink to a donor drum which in turn provides a layer of the imaging suspension to the transparent electrode 1. However, as shown in FIG. 2, the donor drum can be dispensed with and the ink applicator of the present invention can be employed to supply the imaging suspension directly to the transparent electrode 1. Care must be taken, however, in this latter technique to select an imaging suspension wherein the pigment particles are not sufficiently abrasive to score the surface of the transparent electrode. Thus, for greatest versatility in selection of the imaging suspension, it is considered preferable to employ a donor drum in combination with the ink applicator of the present invention as shown in FIG. 1. As shown in the drawings, the liquid applicator of the present invention is adapted to supply a liquid film to a surface regardless of the spatial orientation of the applicator.

Figure 3:
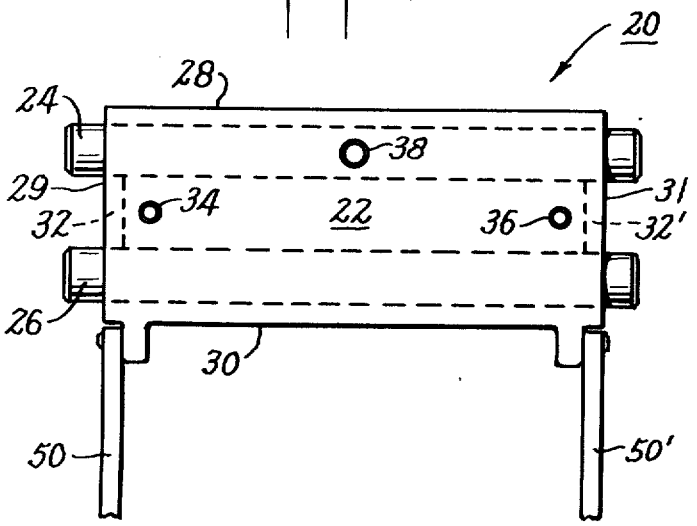
FIG. 3 is a plan view of one embodiment of the liquid applicator of the present invention.

As shown in FIG. 3, the liquid applicator of the present invention is comprised of a blocking member 22 which can be a plate or block of structural material such as metal as, for example, aluminum, steel and the like or a plastic such as a phenolic, teflon, a polycarbonate, nylon and the like or wood. The backing plate is generally rectangular in shape (although the exact shape thereof is relatively immaterial as long as it can cooperate with the sealing means to form a cavity) and coterminous with the width of the donor drum or the surface to which a liquid film is to be applied. The backing plate comprises at least one planar surface (although the planarity of the surface is not considered critical) having opposed leading and trailing endwalls 28 and 30, respectively, and orthogonally disposed sidewalls 29 and 31. Proximate the respective endwalls of the backing plate are situated a pair of spaced endwall sealing members 24 and 26 which can be integral with the backing plate such as by being imbedded therein, superimposed thereon, formed integrally therewith or which can be affixed to said backing plate and adapted to rotate such as by axles or the like. Said sealing members can be rods, rolls or the like extending substantially coterminously with the width of the donor drum or other surface to which a liquid film is to be applied. The sealing members can either conform with the surface to be coated or make tangential contact therewith. One endwall sealing member 24 is situated proximate leading endwall 28 of said plate 22 whereas the other sealing member 26 is situated proximate the trailing endwall 30 thereof. These sealing members can be comprised of metal or plastic and are adapted to form a seal with the surface to be coated. A pair of opposed sidewall sealing members 32 and 32' are affixed integrally with the sidewalls 29 and 31 of the backing plate 22 and extend from said plate laterally to the endwall sealing members 24 and 26 and depend from said plate to effect a seal with the surface to be coated. These sidewall sealing members can similarly be constructed of a plastic such as a phenolic, Teflon, a polycarbonate, nylon or the like or a metal. The backing plate, the pair of endwall sealing members and the pair of opposed sidewall sealing members cooperate with the surface to be coated to form a sealed chamber therebetween adapted to contain liquid such as the imaging suspension. Means are provided such as a pump (not shown) and appropriate charging lines 34 and 36 for charging and withdrawing the imaging suspension to and from said chamber. If desired, at the termination of a given imaging cycle, the imaging suspension can be withdrawn from said chamber and replaced by an appropriate solvent to clean the donor drum or the transparent electrode. Generally, however, other auxiliary cleaning devices can be employed such as a solvent-loaded scrub roll or brush (not shown) preceding reapplication of fresh imaging liquid by the apparatus of the present invention. Means 38 are also provided for regulating the contact pressure of the apparatus with the surface to be coated. For example, the apparatus can be spring mounted or can be brought into contact with the surface to be coated by hydraulic means or the like. By varying the contact pressure brought to bear upon endwall sealing member 24 situated proximate the leading endwall 28 of plate 22, the thickness of the liquid being applied to the donor drum or directly to the transparent electrode can be conveniently controlled. Additional thickness control can be obtained through regulation of the pressure on the circulating imaging suspension by increasing or reducing the flow to the input and output lines 34 and 36. Endwall sealing member 26 situated proximate the trailing endwall 30 of the backing plate 22 together with the sidewall sealing members 32 and 32' effect substantially a liquid-tight seal on three sides of the donor drum or the transparent electrode. Although not considered necessary, vacuum seals can be integrally associated with said endwall and sidewall sealing members to improve the effectiveness of the seal with the donor drum or transparent electrode. Upon relative motion between the liquid applicator 20 of the present invention and the surface to be coated, a thin film of imaging suspension or other liquid can be uniformly applied to the surface. In addition to means 38 for regulating the contact pressure of the apparatus 20 to the surface to be coated, it is considered preferable to employ positioning rods 50 and 50' such as shown in FIG. 3 to maintain the liquid applicator of the present invention in alignment with the donor drum or the surface to be coated. The positioning rods can be affixed to the housing or frame elements (not shown) of the imaging system or to the axles supporting the donor drum or transparent electrode. Although the entire apparatus can be constructed so as to have essentially no moving parts, the endwall sealing means can be rollers adapted to rotate and such rotation can be employed to regulate the ink film thickness and/or to de-agglomerate the particles in the imaging suspension by using the shear forces generated by rapidly rotating at least the endwall sealing member situated proximate the leading endwall of said backing plate in a direction opposite to that of drum rotation. If desired, one or both endwall sealing members can be biased to impart a potential to the imaging suspension to aid in obtaining the desired field strength required for obtaining good image resolution, high image density and low background.

Most advantageously, the liquid applicator of the present invention is adapted to effectively apply a liquid film to a surface regardless of the spatial orientation of the apparatus thereby eliminating the need for maintaining the ink supply in an upright position or for using inks of extremely high viscosity.

Although the liquid applicator of the present invention has been exemplified with reference to photoelectrophoretic imaging systems, it should be readily apparent that the liquid applicator is readily suitable for use in any instance wherein a liquid film is to be applied to the surface of a drum, belt, plate of the like. For example, the liquid applicator can be used in electrophoretic liquid development processes wherein a substrate bearing an electrostatic latent image is contacted with a roll containing an insulating liquid having solid particles suspended therein. The electric field associated with the image causes electrophoresis to occur with resultant development of the image. Also, it can be employed in conjunction with other liquid development techniques such as wetting development or selective wetting development as described in U.S. Pat. No. 3,285,741. Other modifications and areas of application of the present invention will occur to those skilled in the art upon a reading of the present disclosure. These are intended to be included within the scope of this invention.

What is claimed is:

1. An apparatus adapted to supply a liquid to a surface comprising:

i. a backing member having leading and trailing endwalls and opposed sidewalls;

ii. endwall sealing means affixed to said backing member for effecting a seal with the surface to which a liquid is to be applied comprising one sealing member situated proximate the leading endwall, and another member situated proximate the trailing endwall; said latter sealing member being adapted to effect a seal with the surface to which a liquid is to be applied wherein at least the endwall sealing member affixed to the backing member proximate the leading endwall thereon is a roller;

iii. sidewall sealing means for effecting a seal with the surface to which a liquid is to be applied affixed to the sidewalls of said backing member and extending to said endwall sealing member;

said backing member, the trailing endwall sealing member and said sidewall sealing means cooperating with the surface to which a liquid is to be applied to define a chamber therebetween adapted to contain a liquid;

iv. means for supplying liquid for said chamber;

v. means for regulating the contact pressure of said apparatus with the surface to which a liquid film is to be applied, whereby upon relative motion between said apparatus and said surface, a uniform film of liquid is applied to said surface only between the leading endwall sealing member and the surface; and vi. a power source connected to at least one endwall sealing member to electrically bias said sealing member.

2. Apparatus as defined in claim 1 wherein at least one positioning rod is affixed to the backing member and is adapted to maintain the apparatus in alignment with the surface to which liquid is to be applied.

3. Apparatus as defined in claim 1 wherein means for regulating the contact pressure of the apparatus with said surface is affixed to the backing member in the regions thereof proximate the endwall sealing members.

4. Apparatus as defined in claim 1 wherein the means for regulating the contact pressure of the apparatus with said surface is affixed to the backing member in the region thereof proximate the endwall sealing member affixed to the leading endwall of said backing member.

5. The apparatus according to claim 1 wherein at least one positioning rod is pivotally connected proximate the juncture of the backing member and the trailing end wall and is adapted to maintain the apparatus in alignment with the surface to which the liquid is to be applied, and the means for regulating the contact pressure comprises a resilient means affixed to the backing member in the region thereof proximate the leading endwall.

6. An apparatus adapted to supply a liquid film to a surface regardless of the spatial orientation of the apparatus comprising:

i. a backing plate having leading and trailing endwalls coterminous with the width of the surface to which a liquid film is to be applied and orthogonally disposed sidewalls;

ii. endwall sealing means for effecting a seal with the surface to which a liquid is to be applied comprising a pair of spaced endwall sealing members integral with said backing plate and extending coterminously with the width of the surface to which a liquid film is to be applied, one of said members situated proximate the trailing endwall thereof; said latter endwall sealing member being adapted to effect a seal with the surface to which a liquid is to be applied wherein at least the endwall sealing member integral with said backing plate situated proximate the leading endwall thereof is a roller;

iii. sidewall sealing means for effecting a seal with the surface to which a liquid is to be applied comprising a pair of spaced sidewall sealing members integral with the sidewalls of said plate and extending to said endwall sealing member, said sidewall sealing members being adapted to effect a seal with the surface to which a liquid film is to be applied;

said backing plate, the trailing endwall sealing member and sidewall sealing members cooperating with the surface to which a liquid film is to be applied to form a sealed chamber therebetween;

iv. means for charging and withdrawing a liquid to and from said chamber;

v. means for regulating the contact pressure of said endwall sealing members with the surface to which a liquid film is to be applied, whereby upon relative motion between said endwall sealing members and said surface, a liquid film is applied to said surface only between the leading endwall sealing member and the surface; and vi. a power source connected to at least one endwall sealing member to electrically bias said sealing member.

* * * * *